US011598613B2

(12) United States Patent
Brown et al.

(10) Patent No.: US 11,598,613 B2
(45) Date of Patent: Mar. 7, 2023

(54) ALUMINUM VEHICLE HULL STRUCTURE AND FABRICATION METHOD

(71) Applicant: Science Applications International Corporation, Reston, VA (US)

(72) Inventors: Peter Brown, Summerville, SC (US); George S. Chryssomallis, Excelsior, MN (US); Eric Smay, Mount Pleasant, SC (US)

(73) Assignee: Science Applications International Corporation, Reston, VA (US)

( * ) Notice: Subject to any disclaimer, the term of this patent is extended or adjusted under 35 U.S.C. 154(b) by 528 days.

(21) Appl. No.: 16/706,116

(22) Filed: Dec. 6, 2019

(65) Prior Publication Data

US 2021/0172713 A1 Jun. 10, 2021

(51) Int. Cl.
*F41H 7/04* (2006.01)
*C22F 1/04* (2006.01)

(52) U.S. Cl.
CPC ..... *F41H 7/044* (2013.01); *C22F 1/04* (2013.01)

(58) Field of Classification Search
None
See application file for complete search history.

(56) References Cited

U.S. PATENT DOCUMENTS

2010/0288400 A1* 11/2010 Bordesoules ..... C21D 9/50 148/535
2017/0130752 A1* 5/2017 Zhang ..... B23K 9/235

FOREIGN PATENT DOCUMENTS

JP 2004360054 A * 12/2004 ..... B23K 20/1235

OTHER PUBLICATIONS

Burguess, V. "Investigation in Friction Stir Welded Aluminum Alloy 2139-T8 for Hull Structure Applications", Jan. 22, 2019, p. 1-27. (Year: 2019).*
Expeditionary Fighting Vehicle [online]. Retrieved from the Internet: <URL:http://en.wikipedia.org/wiki/Expeditionary_Fighting_Vehicle [retrieved on Sep. 12, 2019].
(Continued)

*Primary Examiner* — George Wyszomierski
*Assistant Examiner* — Janell C Morillo
(74) *Attorney, Agent, or Firm* — Banner & Witcoff, Ltd.

(57) ABSTRACT

Aluminum structures, such as tactical vehicle hulls, include plural aluminum components formed from a first alloy composition and joined by one or more welded seam(s). The welded seam(s) may be formed by friction stir welding and/or gas metal arc welding using welding wire made from the first alloy composition. In this manner, all component parts are made from the same alloy composition, providing a more homogeneous structure. The welded component parts then may be placed in a heat treatment furnace to temper the structure. Because essentially all of the aluminum structure before heat treating—the welded seam(s) and the individual component parts—is formed of the same starting material and these parts/seam(s) are simultaneously and evenly heat treated, the resultant hardened, heat-treated part (e.g., a vehicle hull) has a more homogeneous hardened/heat treated structure in the individual parts and across the welded seam(s).

21 Claims, 6 Drawing Sheets

(56) References Cited

OTHER PUBLICATIONS

CAMEL Helps Designers Make Vehicles 'Safe for Combat'—Defense Update: [online]. Retrieved from the Internet: <URL:http://defense-update.com/20150514_camel.html [retrieved on Sep. 12, 2019].

Niedzinski, Michael, Advanced Aluminum Armor Alloys, Light Metal Age Magazine, Dec. 19, 2016 [online], [retrieved on Sep. 12, 2019]. Retrieved from the internet <URL:https:/www.lightmetalage.com/news/industry-news/flat-rolled-sheet/article-advanced-aluminum-armor-alloys/.

Aluminum 2139 Composition Spec, MatWeb, Material Property Data [online], [retrieved on Sep. 12, 2019]. Retrieved from the internet <URL:www.matweb.com/search/datasheet.aspx?matguid=46ec24a10fc84253adcf076b31deaa14&ckck=1.

Bakavos, D. et al (2008), The effect of silver on microstructural evolution in two 2xxx series Al-alloys with high Cu: Mg ratio during ageing to a T8 temper, Science Direct [online], [retrieved on Dec. 2, 2019]. Retrieved from the Internet: <https://www.sciencedirect.com/science/article/abs/pii/S0921509308002931?via%3Dihub.

Cheeseman, B et al. (2008), Ballistic Evaluation of Aluminum 2139-T8, ResearchGate [online], [retrieved on Dec. 10, 2019]. Retrieved from the Internet <URLhttps://www.researchgate.net/profile/William_Gooch3/publication/292393974_Ballistic_Evaluation_of_Aluminum_2139-T8/links/56ae22e408aeaa696f2e9a17/Ballistic-Evaluation-of-Aluminum-2139-T8.pdf?origin=publication_detail.

Vural, M et al (2009), Experimental analysis and constitutive modeling for the newly developed 2139-T8 alloy, Materials Science and Engineering [online], [retrieved on Dec. 10, 2019]. Retrieved from the Internet <URL:https://www.sciencedirect.com/science/article/abs/pii/S0921509309005991.

Burguess, V. et al, Investigating Friction Stir Welding in Aluminum Hull Structures, Summer 2019 [online], [retrieved Dec. 17, 2019]. Retrieved from the internet <URL:https://www.dsiac.org/resources/journals/dsiac/summer-2019-volume-6-number-3/investigating-friction-stir-welding-aluminum.

* cited by examiner

ALUMINUM VEHICLE HULL STRUCTURE AND FABRICATION METHOD

GOVERNMENT LICENSE RIGHTS

This invention was made with Government support under Contract No. N00014-19-S-B002 awarded by the Office of Naval Research (ONR). The Government has certain rights in this invention.

BACKGROUND

Aluminum armor vehicles typically have been formed from armor temper aluminum parts (e.g., aluminum 2139-T8). Because the armor temper aluminum parts (e.g., aluminum 2139-T8) are not highly workable, a typical armored vehicle hull is formed by several component parts that are joined together by welding. These welded joints typically include aluminum 4043 or aluminum 2319 weld wire joining the component parts by gas metal arc welding ("GMAW").

In such aluminum vehicle hull structures, the arc-welded joints typically are considerably weaker than the base aluminum materials because the arc welding process weakens the aluminum of the welded joint (also called "heat affected zones" or "HAZ"). HAZ can reduce joint strength by 50% or more, introduce ballistic weakness, and can affect large areas of a structure. Because several parts are joined together in a vehicle hull structure by these arc welded joints, several areas of weakness may exist in the overall vehicle hull structure. To compensate for weakness introduced by the arc-welded joints, the component parts are made very thick (e.g., typically about 1.5 to 2 inches (38 mm to 51 mm) thick or even more) so that the overall welded joints also can be made thicker. The thicker joints and seams provide more material holding the parts together at the seams, making them more resistant to failure from external forces, such as a blast. Such joints, however, also are susceptible to corrosion and stress cracking.

The increased thickness of the parts and joints also introduces significant additional weight to the vehicle hull structure. This increased weight adversely affects the payload size, speed, range, operating costs (e.g., fuel costs), and/or material costs for the vehicle.

SUMMARY

This Summary introduces a selection of concepts relating to this technology in a simplified form as a prelude to the Detailed Description. This Summary is not intended to identify key or essential features.

Aspects of this disclosure relate to aluminum structures, such as tactical vehicle hulls, that include: (a) a first aluminum component formed from a first alloy composition; (b) a second aluminum component formed from the first alloy composition; and (c) a gas metal arc-welded joint joining the first aluminum component to the second aluminum component, wherein the gas metal arc-welded joint comprises an aluminum alloy weld material formed from the first alloy composition.

Additional aspects of this disclosure relate to methods of making aluminum structures, such as tactical vehicle hulls, from aluminum alloy component parts. Such methods may include, for example: (a) placing a first aluminum component having a first alloy composition adjacent a second aluminum component having the first alloy composition; (b) gas metal arc welding the first aluminum component to the second aluminum component with an aluminum alloy weld material (e.g., formed as welding wire) to form a welded part having a gas metal arc welded joint, wherein the aluminum alloy weld material has the first alloy composition; and (c) after welding, heat treating the welded part to simultaneously temper and harden the first alloy composition of the first aluminum component, the second aluminum component, and the aluminum alloy weld material to form a heat treated part. In this manner, essentially all of the aluminum structure before heat treating—including the welded seam(s) and the individual component parts—is formed of the same starting material. These parts/seam(s) are simultaneously and evenly heat treated to form the hardened, heat-treated part having a more homogeneous hardened/heat treated structure throughout the individual parts and welded seam (s).

The aluminum alloy of the first alloy composition in the structures and methods described above (and thus of the first aluminum component, the second aluminum component, and the aluminum alloy weld material) may be an aluminum alloy in the 2000 series. Aluminum 2000 series alloys typically can be precipitation hardened to strengths comparable to steel. Aluminum 2000 series alloys include aluminum alloyed primarily with copper (e.g., 2% to 10%), but often with one or more alloying elements, such as: silicon, iron, manganese, magnesium, chromium, zinc, titanium, silver, vanadium, zirconium, lead, bismuth, lithium, and/or nickel. All percentages used herein for alloy percentages are weight percent (wt %), unless otherwise noted.

More specific aluminum alloy compositions useful in accordance with at least some aspects of this technology include aluminum 2139-T34 (e.g., prior to a heat treatment step) and aluminum 2139-T84 (e.g., after a heat treatment step). For purposes of this disclosure, unless otherwise noted or clear from the context, the term "aluminum 2139" will include any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

Aluminum structures and aluminum joining methods in accordance with at least some examples of this disclosure and technology may include one or more friction stir welded joints along with the gas metal arc-welded joint(s). Aluminum structures formed with both types of joints (e.g., and particularly with an aluminum 2139-T34 starting material heat treated to an aluminum 2139-T84 temper after welding) may be well suited for aluminum armored vehicle hulls, e.g., for tactical vehicles. In at least some examples of these systems and methods, such vehicle hulls (or other joined aluminum alloy parts) may include more linear inches or mm of friction stir welded ("FSW") joints than linear inches or mm of gas metal arc-welded joints. In some more specific examples, two or more vehicle hull component parts may be fixed together by a plurality of welded joints that include: (a) a plurality of friction stir welded joints forming a total friction stir welded seam length $L_{TFSW}$ joining the plurality of component parts and (b) a plurality of gas metal arc-welded joints forming a total gas metal arc-welded seam length $L_{TGMAW}$ joining the plurality of component parts, wherein a ratio of $L_{TFSW}$:$L_{TGMAW}$ joining any two or more component parts and/or in the overall vehicle hull construction is greater than 1, and in some examples, within a range of 1.5 to 5 or within a range of 1.75 to 4.

These and other features of this technology are described in more detail below.

BRIEF DESCRIPTION OF THE DRAWINGS

Some features are shown by way of example, and not by way of limitation, in the figures of the accompanying drawings and in which like reference numerals refer to similar elements.

DETAILED DESCRIPTION

Figure 1:
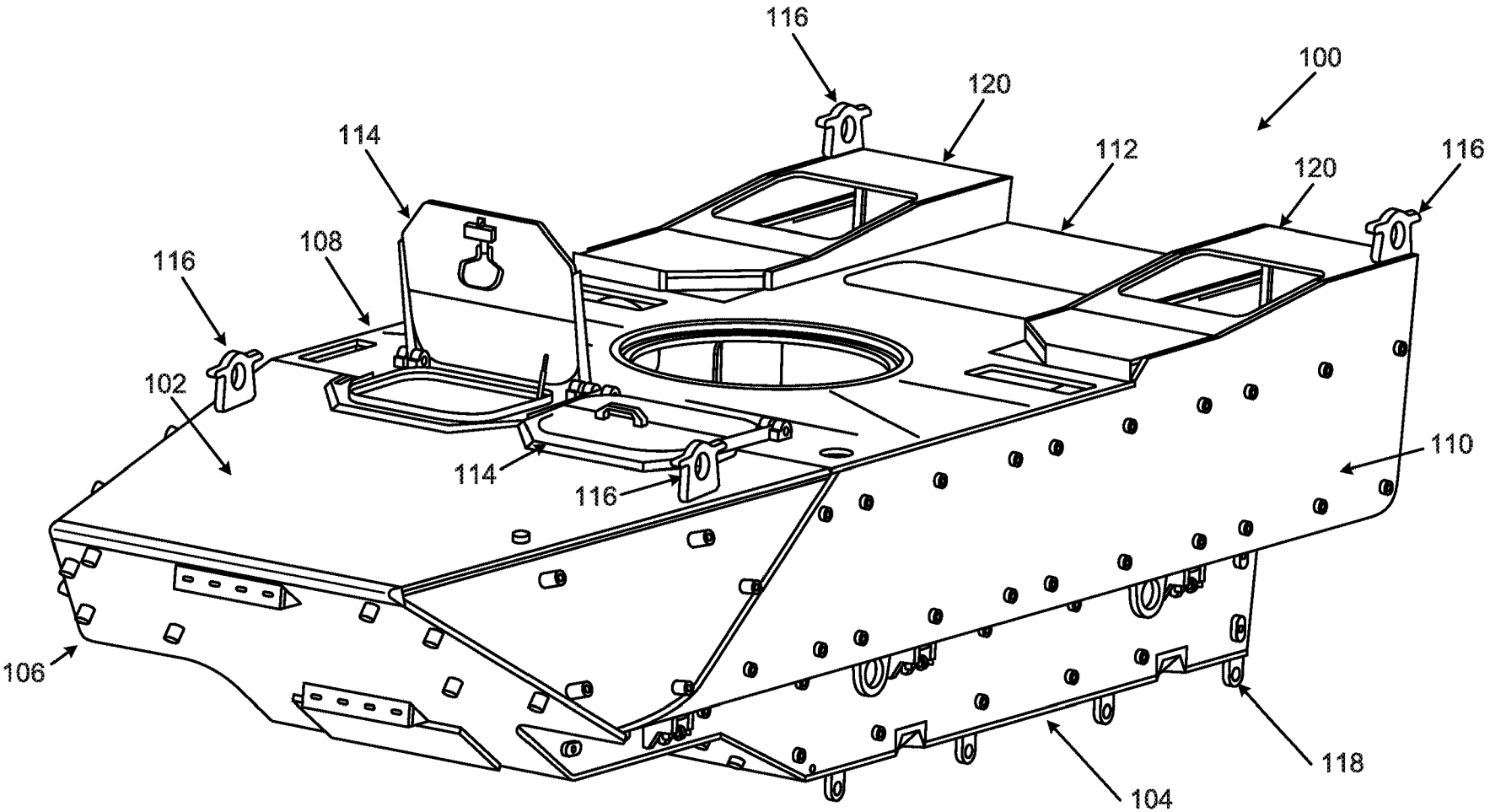
FIG. 1 illustrates an example armored vehicle hull in accordance with at least some examples of this technology.

As described above, aluminum armor vehicles typically have been formed by gas metal arc-welding armor temper aluminum parts (e.g., made from aluminum 2139-T8) together using aluminum 4043 or aluminum 2319 weld wire. Thus, the resultant welded structure includes at least two distinct materials/structures (i.e., it is non-homogeneous): (a) the aluminum alloy component part compositions (e.g., aluminum 2139-T8) and (b) the weld wire material (e.g., aluminum 4043 and 2319). Because the arc-welded joints typically are considerably weaker than the homogeneous base aluminum 2139-T8 materials (e.g., due to HAZ), the component parts typically are made quite thick (e.g., typically about 1.5 to 2 inches (38 mm to 51 mm) thick or even more) so that the overall arc welded joints are made thicker. The thicker welded joints better resist failure against forces to which these vehicles may be exposed. But, the greater thickness of the parts and joints introduces significant additional weight to the vehicle hull structure and make the joints susceptible to corrosion and stress cracking. These disadvantages adversely affect payload size, speed, range, operating costs (e.g., fuel costs), material costs, and/or useful life for the vehicle.

Aspects of the present technology differ from these known structures and processes in various respects. As some examples, aspects of the present technology may include any one or more of the following features:

- use of an alloy composition for gas metal arc weld wire that is the same as the alloy composition of the parts being joined;
- use of aluminum 2139-T34 as the starting material for the aluminum alloy parts and the weld wire;
- combined use of friction stir welded joints and gas metal arc-welded joints when joining aluminum alloy component parts (e.g., having a ratio of (a) a total friction stir welded seam length $L_{TFSW}$ to (b) a total gas metal arc-welded seam length $L_{TGMAW}$ greater than 1, and in some examples, within a range of 1.5 to 5 or within a range of 1.75 to 4); these ratio ranges may apply to any two joined parts in the vehicle hull structure, any two or more combined joined parts in the vehicle hull structure, and/or in the full vehicle hull structure;
- use of a more workable aluminum alloy composition (e.g., aluminum 2139-T34) as the starting component parts before heat treatment;
- an armored vehicle hull having at least 50% (and in some examples, at least 60%, at least 75%, at least 85%, at least 90%, at least 95%, or even up to 100%) of its structure formed from aluminum alloy components less than 1 inch (25.4 mm) thick (measured directly through the part from one major surface to its opposite major surface);
- an armored vehicle hull having one or more bent component parts wherein one or more of the bends have a bend radius less than 95 mm, and in some examples, less than 80 mm, less than 70 mm, less than 60 mm, or even less than 50 mm;
- an armored vehicle hull having one or more bent component parts wherein one or more of the bends have radius ("R") to thickness ("t") ratio, i.e., R/t ratio, of less than 3, and in some examples, less than 2.5, less than 2, less than 1.75, less than 1.5, or even less than 1.4.
- simultaneously heat treating all vehicle hull component parts (e.g., all parts forming the shell of the vehicle hull) after all welding steps have been completed to simultaneously and evenly harden the component parts and the weld joints;
- forming all vehicle hull component parts (e.g., all parts forming the shell of the vehicle hull), including the gas metal arc-welded joints, from the same aluminum alloy composition prior to heat treating (e.g., all parts having a homogeneous or substantially homogeneous structure before heat treating); and/or
- simultaneously heat treating all vehicle hull component parts (e.g., all parts forming the shell of the vehicle hull) after all welding steps have been completed to form a final, heat treated part having a homogeneous or substantially homogeneous structure both in the component parts and across the friction stir welded and gas metal arc-welded joints/seams.

As noted above, aspects of this technology may use an aluminum alloy from the 2000 series as the starting material. Aluminum alloys from the 2000 series generally include the following compositions: aluminum alloyed primarily with copper (e.g., 2% to 10%), but often with one or more alloying elements, such as: silicon, iron, manganese, magnesium, chromium, zinc, titanium, silver, vanadium, zirconium, lead, bismuth, lithium, and/or nickel. As some more specific examples, aluminum alloy compositions useful in accordance with at least some aspects of this technology include aluminum 2139-T34 (e.g., prior to a heat treatment step) and aluminum 2139-T84 (e.g., after a heat treatment step). For purposes of this disclosure, unless otherwise noted or clear from the context, the term "aluminum 2139" will include any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

As described herein, the weld wire used for forming the gas metal arc-welded joints and seams in accordance with aspects of this technology may be made from the "same alloy composition" (often referred to herein as the "first alloy composition") as used in the component parts joined together by those welded joints/seams. Those skilled in the art recognize that such alloy compositions may vary somewhat in their overall compositions, e.g., from lot to lot, from manufacturer to manufacturer, etc. Thus, alloys having minor compositional differences, e.g., differences in amounts of one or more alloy components that do not affect the relevant properties or performance of the resultant alloy for its intended use, are considered the "same alloy" or have "the first alloy composition" as those terms are used herein. As some more concrete examples, any alloys that fall within a manufacturer's specifications (or government contract specifications) for a specific aluminum alloy within the 2000 series constitute the "same alloy" and/or are made from "the first alloy composition" as those terms are used herein, even if the individual specific alloy compositions are not identical. Likewise, any alloys that fall within a manufacturer's specifications or a government contract specifications for aluminum 2139 constitute the "same alloy" and/or are made from "the first alloy composition" as those terms are used herein, even if the individual specific alloy compositions are not identical. The intent in including this definition in the specification is to include minor variations in composition (e.g., production lot-to-production lot variations, manufacturer-to-manufacturer differences, etc.) within the scope of the terms "same alloy" or "first alloy composition" if those minor changes do not affect the properties or performance of the alloy for its intended use.

In addition, the terms "homogeneous" and "substantially homogeneous" as used herein permit some minor variations in the aluminum alloy structure and/or composition across the overall volume of the joined components and their weld joints/seams. For example, the outer surfaces of the components (e.g., edge effects) and/or the extreme boundaries between the component part structures and the beginning of the welded seams may display some variations in the structure/composition of the alloys (even when the "same alloy" composition is used in the parts and the weld seam). When the "same alloy" compositions (e.g., in one or more component parts and in one or more welded seams) are simultaneously exposed to the same heat treatment conditions in a single furnace and as a single joined (e.g., welded) component part, absent other external influences, it is expected that the resultant heat treated part will have a "homogeneous" or "substantially homogeneous" structure. The term "substantially homogeneous," as used herein, means aluminum alloy structures and/or compositions contained within a component (which may be formed from two or more parts joined together, e.g., by welding) that, by volume of the component, are composed of at least 75% of the same aluminum alloy structure and/or composition (meaning "at least 75% homogenous" by volume). In some examples, a "substantially homogeneous" aluminum alloy of a component (which may be formed from two or more parts joined together, e.g., by welding) will be at least 80% homogeneous in aluminum alloy structure and/or composition by volume, and in some examples, at least 85% homogeneous by volume, at least 90% homogeneous by volume, or even at least 95% homogeneous by volume.

The terms "joints" and "seams" are used interchangeably in this specification and refer to the same welded joining structures. The term "weld wire," as used herein, refers to any structural form of material suitable for gas metal arc welding, including consumable rods, wires, or other electrodes.

More specific examples of aspects of this technology now will be described. FIG. 1 illustrates a vehicle hull 100 for a tactical aluminum armored vehicle in accordance with at least some examples of this technology. The vehicle hull 100 includes a top surface 102, a bottom surface 104, a front surface 106 (angled, in this example), two side surfaces 108, 110, and a rear surface 112. Each of these surfaces 102, 104, 106, 108, 110, 112 may be formed from one or more individual parts made from sheets of aluminum alloy starting material that are welded together to form an overall vehicle hull 100. Other components, such as hatch covers 114, lifting and tie-down cleats 116, mount components 118 (e.g., mounts for propulsion system parts, weapons, etc.), and/or other components 120, may be engaged with the larger hull component parts that form these main surfaces 102, 104, 106, 108, 110, 112. These other components 114, 116, 118, 120 also may be engaged with the main hull structural component parts by welding (or other techniques). These additional components 114, 116, 118, 120, when present, may be considered additional components attached to a base vehicle hull 100 (with the vehicle hull 100 being considered the main component parts that form the base outer surfaces 102, 104, 106, 108, 110, 112 of the vehicle structure).

Figure 2:
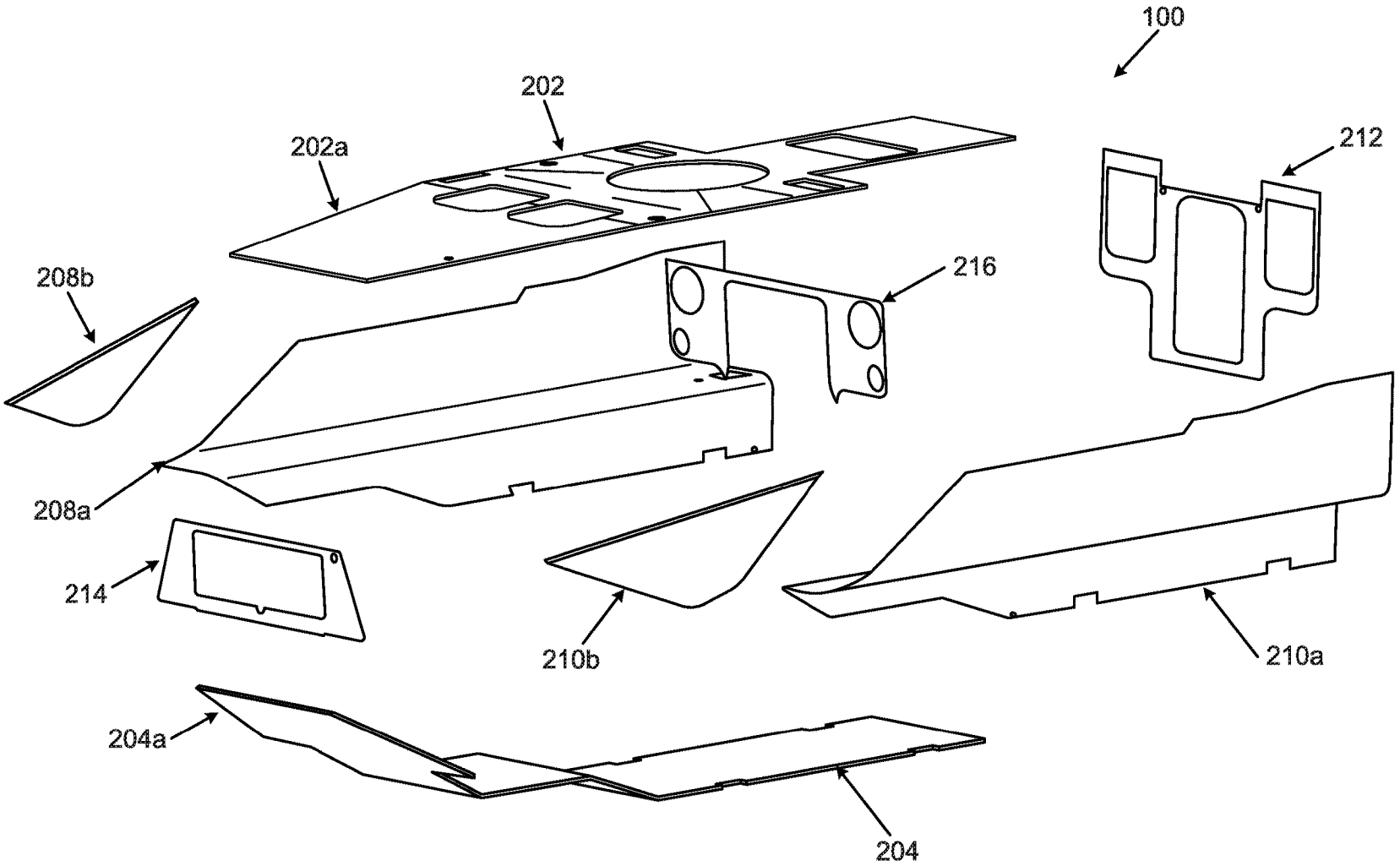
FIG. 2 is an exploded view showing various hull component parts of the example armored vehicle hull of FIG. 1.

FIG. 2 shows an exploded view of the main component parts for a vehicle hull 100 in accordance with one example of this technology. As shown in FIG. 2, this example vehicle hull 100 includes a top component part 202 that forms all or a majority of the top surface 102 of this example vehicle hull 100. A bottom component part 204 forms all or a majority of the bottom surface 104 of this example vehicle hull 100. The front surface 106 of this example vehicle hull 100 structure includes the downwardly angled portion 202*a* of top component part 202 and upwardly angled portion 204*a* of the bottom component part 204. Each of the side surfaces 108, 110 of this example vehicle hull 100 includes a main side component part 208*a*, 210*a* (forming a majority of the side surfaces 108, 110, respectively, toward the front of the hull 100) and a front side component part 208*b*, 210*b* (forming a minority of the side surfaces 108, 110, respectively toward the front of the hull 100). Alternatively, if desired, one or both side surface 108, 110 may be formed of a single hull component part. Also, all or at least a majority of the rear surface 112 in this example vehicle hull 100 is formed by rear component part 212. Parts 214 and 216 in FIG. 2 constitute interior panels or firewalls incorporated into the vehicle hull 100 construction of this example. More or fewer component parts may be included in the hull 100 structure. Additionally or alternatively, additional parts may be attached to any one or more of these component parts 202, 204, 208*a*, 208*b*, 210*a*, 210*b*, 212.

Figure 4:
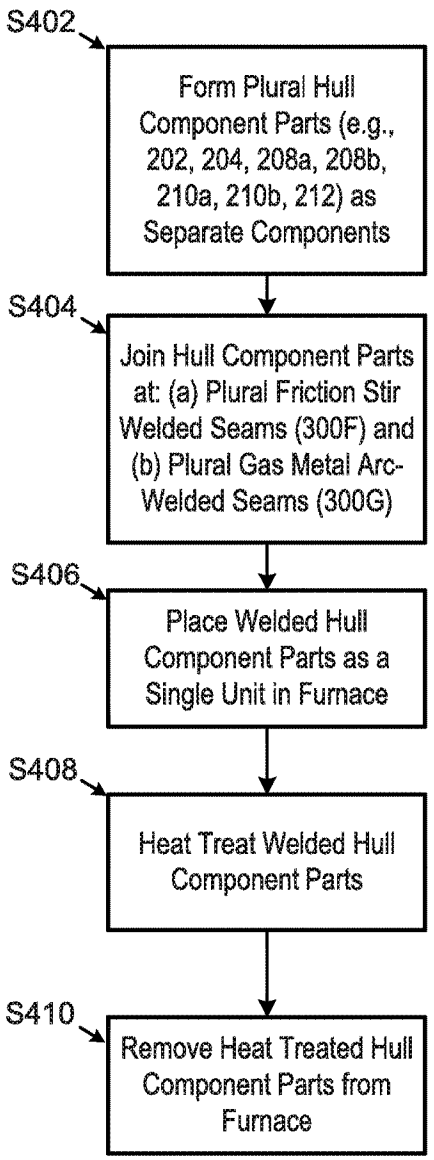
FIG. 4 is a flow chart outlining steps involved in a method of fabricating armored vehicle hulls in accordance with at least some examples of this technology.

One advantageous aspect of at least some examples of this technology relates to potential use of a thinner starting material that has improved workability, ductility, machinability, and/or bendability (e.g., a sheet of aluminum alloy, such as aluminum 2139-T34, 1 inch (25.4 mm) thick or less (e.g., about 0.75 in. (20 mm) in some examples)) as compared to conventional aluminum 2139-T8 starting materials used in existing vehicle hulls (that are typically 1.75 in. (44 mm) to 2 in. (51 mm) thick or more). This change in starting material enables production of larger vehicle hull component parts (as compared to the conventional technique), because a single part can be bent or otherwise worked/machined to form different surfaces or areas of the vehicle hull structural panel rather than joining several independent parts together to form the same structural panel. As a more specific example, aluminum 2139-T34 ductility allows for tighter and more precise bend radii reducing the requirement for welded seams and allowing the hull to be fabricated out of several large parts vs. many smaller parts (e.g., a reduction of number of hull plate components forming an overall vehicle hull, relative to vehicle size, by about 30% as compared to a conventional vehicle hull). All of component parts 202, 204, 208*a*, 208*b*, 210*a*, 210*b*, and 212 in the vehicle hull 100 structure of FIG. 2 may be formed from this relatively thin (e.g., less than 1 inch (25.4 mm) thick) and more workable, ductile, and/or bendable starting material. More specifically, starting sheets of an aluminum alloy composition (e.g., aluminum 2139-T34, etc.) can be machined, bent, and/or otherwise worked to include the desired openings, structural shapes, and the like. Additionally, if desired, hatch cover parts 114, interior parts 214 and 216, cleats 116, mounts 118, and/or components 120 may be formed from this same starting material alloy composition that is more workable, ductile, and/or bendable (optionally, in the form of relatively thin sheets, e.g., less than 1 inch (25.4 mm) thick). These steps correspond to step S402 in the fabrication flow chart shown in FIG. 4.

Once formed and shaped, the component parts 202, 204, 208*a*, 208*b*, 210*a*, 210*b*, and 212 are joined by welding (step S404, FIG. 4) to form the vehicle hull 100. Additional advantageous aspects of at least some examples of this technology relate to the welding steps for forming the vehicle hull 100 from its component parts. As noted above, in conventional constructions, relatively thick (e.g., 1.75 inches (44 mm) or greater) aluminum 2139-T8 component parts are welded to one another using gas metal arc welding processes using 4043 or 2319 weld wire. These processes generate HAZ. In accordance with at least some aspects of this technology, the welded seams joining the component parts 202, 204, 208*a*, 208*b*, 210*a*, 210*b*, and 212 have reduced or no HAZ. These welded seams include both: (a) gas metal arc-welded seams using the same aluminum alloy composition as that forming the component parts 202, 204, 208*a*, 208*b*, 210*a*, 210*b*, and 212 and (b) friction stir welded seams. Friction stir welding uses a non-consumable tool (e.g., a drill bit) to join two facing metal parts together without melting either part. Friction induced heat generated between the rotating tool and the parts softens the parts near the tool. As the tool moves along the joint line, the hot and softened metals are pressed together and join. Friction stir welding is advantageous in that it produces no HAZ in the joined parts, and the joint or seam has a homogeneous structure with the remainder of the parts. More specifically, component parts 202, 204, 208*a*, 208*b*, 210*a*, 210*b*, and 212 made from the same aluminum alloy composition (e.g., aluminum 2139-T34) will create a friction stir welded joint having this same aluminum alloy composition and structure (e.g., aluminum 2139-T34).

Friction stir welding processes, however, cannot be accomplished easily and conveniently in all situations. For example, some areas may be too tight, may be too angled, and/or may have insufficient space between parts to allow friction stir welding to be performed. In such areas, in accordance with examples of this technology, the component parts 202, 204, 208*a*, 208*b*, 210*a*, 210*b*, and 212 are joined by gas metal arc welding processes. While gas metal arc welding processes are generally known in the art, in accordance with examples of the present technology, two (or more) component parts each made from a first aluminum alloy composition (e.g., aluminum 2139-T34 in some examples) are arc-welded using a metal wire also formed from this same first aluminum alloy composition (e.g., aluminum 2139-T34 in some examples). Thus, the aluminum alloy weld wire composition (e.g., aluminum 2139-T34) creates gas metal arc-welded joints having the same aluminum alloy composition and structure as the hull component parts 202, 204, 208*a*, 208*b*, 210*a*, 210*b*, 212 (e.g., aluminum 2139-T34).

Figure 3A:
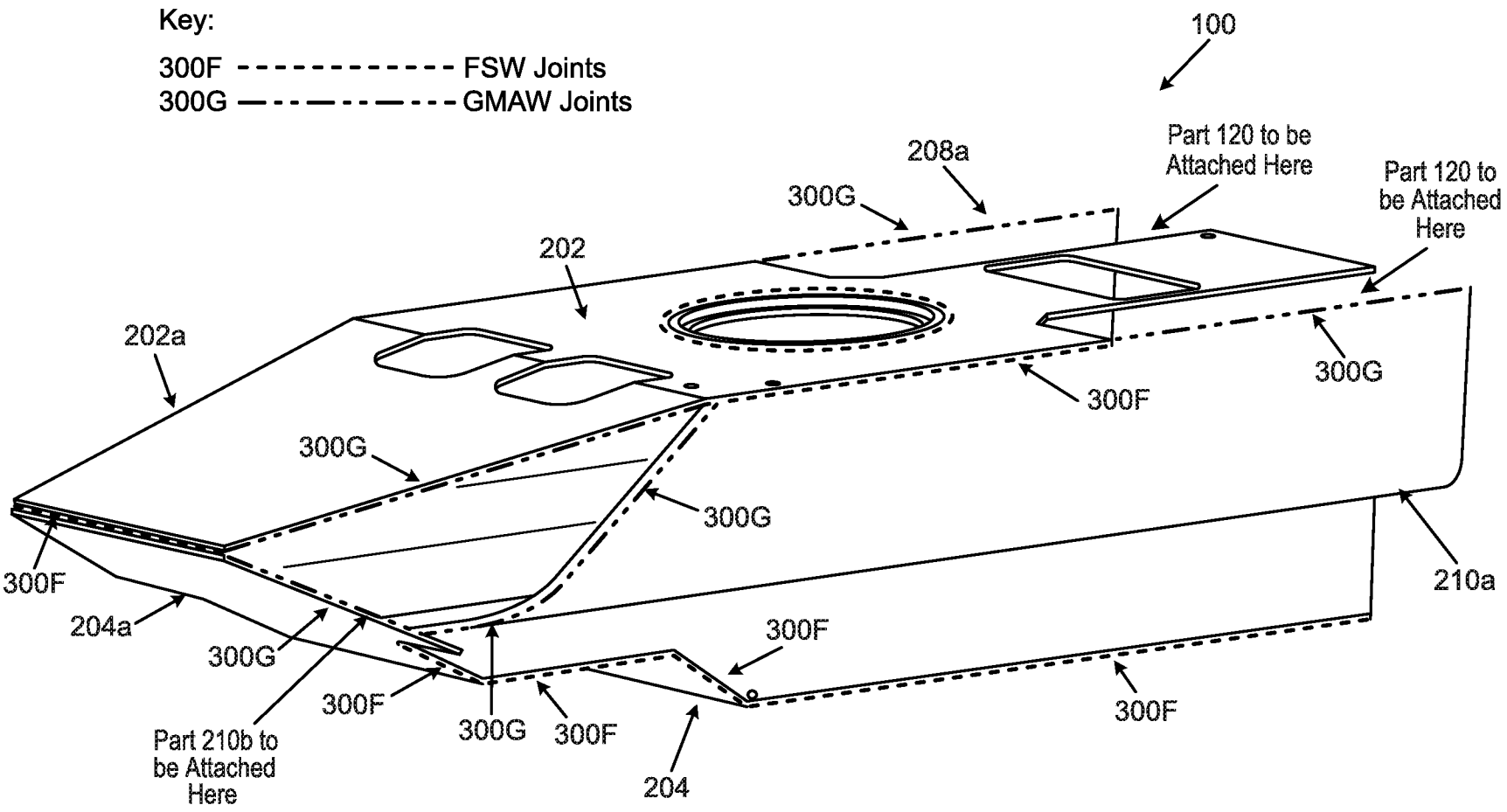
FIGS. 3A, 3B, and 3C show various views of a partially assembled vehicle hull highlighting locations of various weld types.
Figure 3B:
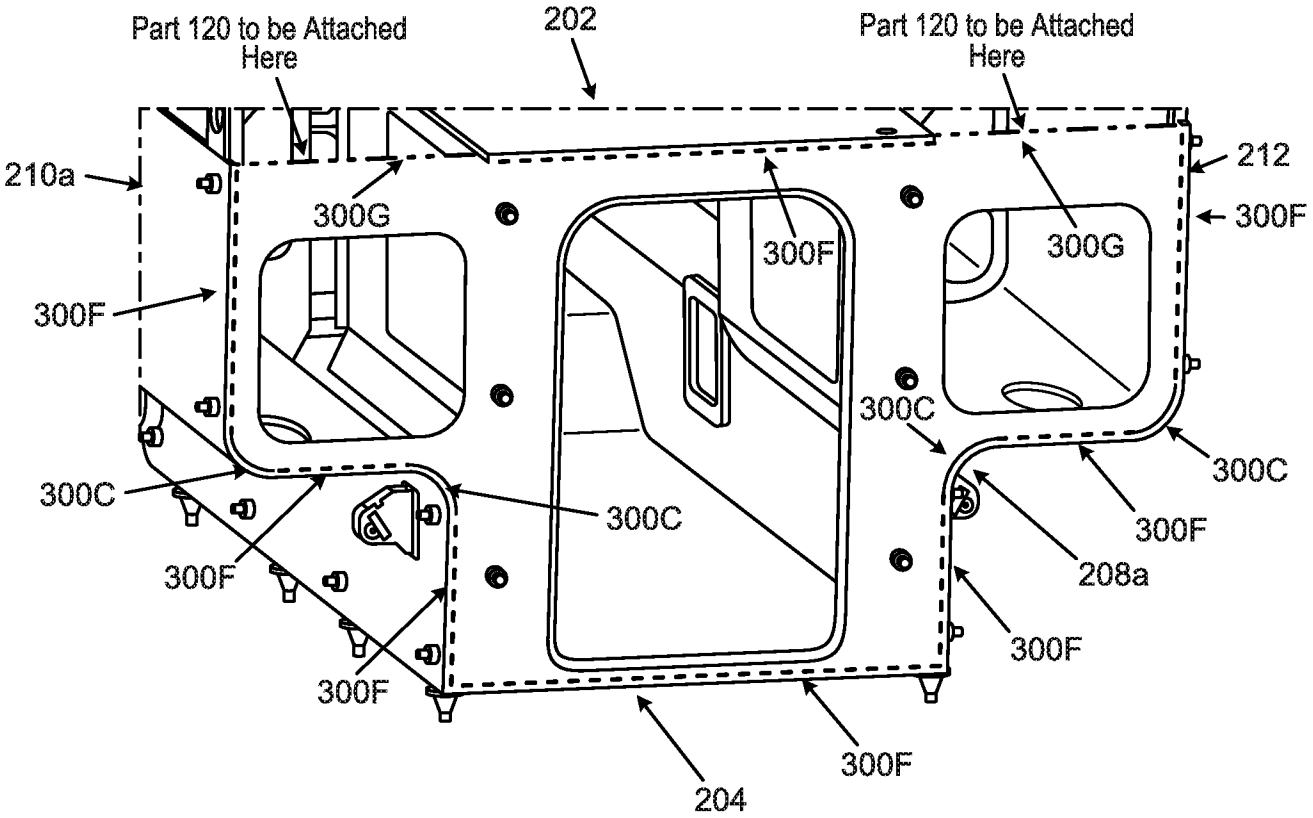
Figure 3C:
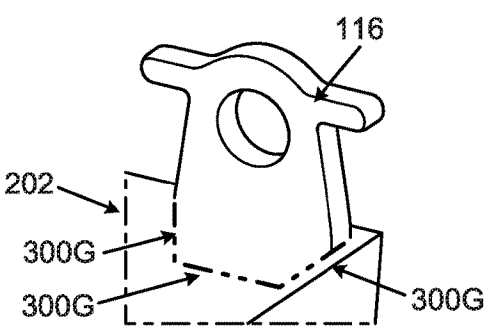

FIGS. 3A-3C show various welded joints or seams in one example vehicle hull 100 structure according to this technology. FIG. 3A shows a top, front, left side perspective view of this example vehicle hull 100 (the right side and its joints being a mirror image of this left side view) and FIG. 3B shows a rear, left side, perspective view thereof (the right side and its joints being a mirror image of this left side view). In these views, the joints labeled 300F represent friction stir welded joints and the joints labeled 300G represent gas arc-welded joints. Also, in FIG. 3B, where no joint or seam is highlighted between parts around the rounded corners 300C, these parts (i.e., the rear component part 212 and the side component parts 208A, 210*a*) are joined at those adjacent locations by fused stir welded joints 300F.

As shown in the specific example of FIG. 3A, the top component part 202 is joined to the main sidewall component part 210*a* (and the other main sidewall component part 208*a*) by friction stir welded seams 300F and to the bottom component part 204 (at the front end) by a friction stir welded seam 300F. The main sidewall component part 210*a* is joined to the bottom component part 204 by a friction stir welded seam 300F (and similar, mirror image friction stir welded seams 300F join the right sidewall component part 208*a* to the bottom component part 204). The smaller sidewall part 210*b* may be joined to the top component part 202 (at front portion 202*a*), bottom component part 204 (at front portion 204*a*), and main sidewall component part 210*a* by gas metal arc welded seams 300G. Opposite sidewall part 208*b* may be connected to the top component part 202, the bottom component part 204, and right main sidewall component part 208*a* by similar (mirror image) gas metal arc welded seams 300G as well.

Also, as shown in FIG. 3B, the rear component part 212 is joined to the main sidewall component parts 208*a*, 210*a* and the bottom component part 204 primarily by friction stir welded joints. Gas metal arc-welded joints 300G may be used along the top line, e.g., to join the rear component part 212 with other vehicle parts 120 shown at the top rear of the vehicle hull 100 in FIG. 1. Alternatively, the top component part 202 may extend to these extreme rear corners of the vehicle hull 100. When present, these other vehicle parts 120 may be formed from the same aluminum alloy as that forming the component parts 202, 204, 208*a*, 208*b*, 210*a*, 210*b*, and 212 (e.g., aluminum 2139-T34 or other alloy).

FIG. 3C shows lifting and toe-down cleats 116 may be engaged with the top component part 202*a* and/or other component part via gas metal arc-welded joints 300G. Other parts (such as hatch covers 114, other mounts 118, and/or other structures 120) also may be engaged with one or more of the base hull component parts 202, 204, 208*a*, 208*b*, 210*a*, 210*b*, and/or 212 by gas metal arc-welded joints and/or friction stir welded joints.

Thus, in at least some examples of this technology, any two or more vehicle hull component parts 202, 204, 208*a*, 208*b*, 210*a*, 210*b*, and 212, or even all of these hull component parts may be fixed together by a plurality of welded joints that include: (a) a plurality of friction stir welded joints 300F forming a total friction stir welded seam length $L_{TFSW}$ joining any two or more of the plurality of component parts 202, 204, 208*a*, 208*b*, 210*a*, 210*b*, and 212 and (b) a plurality of gas metal arc-welded joints 300G forming a total gas metal arc-welded seam length $L_{TGMAW}$ joining any two or more of the plurality of component parts 202, 204, 208*a*, 208*b*, 210*a*, 210*b*, and 212, wherein a ratio of $L_{TFSW}$:$L_{TGMAW}$ joining any two or more component parts 202, 204, 208*a*, 208*b*, 210*a*, 210*b*, and 212 and/or in the overall vehicle hull construction is greater than 1, and in some examples, within a range of 1.5 to 5 or within a range of 1.75 to 4.

After the stage of the production process in which the above welds are formed, and in at least some examples of this technology, all of the main vehicle hull body component parts (e.g., 202, 204, 208*a*, 208*b*, 210*a*, 210*b*, and 212) and preferably any other parts (e.g., 114, 116, 118, 120) to be welded onto the main vehicle hull body component parts are fixed together by the friction stir welded joints 300F and/or the gas metal arc-welded joints 300G. Additionally: (a) all of the main vehicle hull body component parts (e.g., 202, 204, 208*a*, 208*b*, 210*a*, 210*b*, and 212), (b) the friction stir welded joints 300F, (c) the gas metal arc-welded joints 300G, and (d) any other parts (e.g., 114, 116, 118, 120) to be welded onto the main vehicle hull body component parts are formed from the same alloy composition (e.g., a workable aluminum 2000 series alloy, such as aluminum 2139-T34). Thus, the hull component parts (e.g., 202, 204, 208*a*, 208*b*, 210*a*, 210*b*, and 212), its welded seams 300F, 300G, and any add on components (e.g., 114, 116, 118, 120), when present, have a homogeneous (or substantially homogeneous) structure and composition (made from the same alloy composition, e.g., all aluminum 2139-T34 in this specific example).

This workable aluminum alloy composition (e.g., aluminum 2139-T34), however, has insufficient strength and rigidity to function as armor for a tactical vehicle hull under conditions to which such vehicles may be exposed. Thus, in a next step (step S406, FIG. 4), the entire welded vehicle hull 100 structure (the hull component parts (e.g., 202, 204, 208*a*, 208*b*, 210*a*, 210*b*, and 212), its welded seams (e.g., 300F, 300G), and any present add on components (e.g., 114, 116, 118, 120)) is placed in a heat treatment furnace as a unit. Then, the hull structure 100 is heat treated to age the starting alloy material and harden it to an armor temper. As all the hull materials, including the weld seams (both the friction stir welded seams and the gas metal arc-welded seams), are formed from the same alloy and temper prior to the heat treatment steps, during the heat treatment steps, the structure transitions evenly and homogeneously, e.g., to aluminum 2139 with the T84 temper.

The example heat treatment procedure (step S408, FIG. 4) described below is based on the conditions used for creating a vehicle hull 100 starting with aluminum 2139-T34 as a starting material and heat treating it to an aluminum 2139-T84 temper. Different conditions and specific settings may be used, e.g., for other starting materials and weld wire materials, as needed to produce the final desired product specifications. The heat treatment steps for this specific example aluminum 2139-T34 to aluminum 2139-T84 transition include:

(a) placing the entire welded vehicle hull structure, with fully welded joints (the hull component parts (e.g., 202, 204, 208*a*, 208*b*, 210*a*, 210*b*, and 212), its welded seams (e.g., 300F, 300G), and any present add on components (e.g., 114, 116, 118, 120), in a heat treatment furnace as a unit;

(b) pre-heating the furnace to a temperature below a temperature at which significant change to the alloy/component parts/welded joint material takes place (e.g., approximately 160 F±15 F);

(c) continue preheating until the furnace and vehicle hull structure are at a substantially constant temperature (e.g., all thermocouples register at the same temperature±15 F);

(d) ramping up temperature in the furnace, e.g., at approximately 31.25 F/hr (±5 F/hour) to reach 310 F (±5 F) within 4.8 hours±0.5 hours;

(e) once all thermocouples are >310 F, start a soak timer;

(f) soak (i.e., hold) at 320 F±5 F for 24 hours±5 minutes; and (g) once soak term is completely, remove from furnace (step S410, FIG. 4) and cool in ambient air.

These heat treatment conditions treat the base hull component parts (e.g., 202, 204, 208*a*, 208*b*, 210*a*, 210*b*, and 212), the friction stir welded seams (e.g., 300F), and the gas metal arc-welded seams (e.g., 300G), as well as any other present parts made from the same alloy composition (e.g., 114, 116, 118, 120), consistently and evenly, thereby tempering the aluminum 2139-T34 starting materials to an aluminum 2139-T84 temper. The resulting hull component product 100 has substantially its entire structure formed from a homogeneous aluminum material, namely aluminum 2139-T84. The resulting heat treated vehicle hull 100 structure has reduced HAZ, improved weld joint strength, and/or reduced thickness and/or weight as compared to conventional hull structures formed from aluminum 2139-T8 welded with aluminum 4043 or aluminum 2319 weld wire by gas metal arc welding.

Testing

The mechanical behavior of a monocoque, 2139-T84 aluminum alloy structure in accordance with aspects of this technology has been evaluated through hardness and uniaxial tension experiments over a range of strain rates. The starting materials for forming the test parts was 2139-T34 aluminum alloy provided in plate form with the dimensions of 120 in.×240 in.×1 in (3048 mm×6096 mm×25.4 mm). This material was faced to a thickness of 20 mm with a nominal flatness of 0.030 in. (0.76 mm) The chemical composition of alloy is given in Table 1:

TABLE 1

Al 2139-T34 Lot 9456280 Chemical Composition Chemistry (Actual, Percent by Weight (Wt %))

| Si | Fe | Cu | Mn | Mg | Cr | Zn | Ti | Zr | Ag | V |
|---|---|---|---|---|---|---|---|---|---|---|
| 0.03 | 0.04 | 4.9 | 0.32 | 0.46 | — | — | 0.09 | 0.01 | 0.38 | — |

Others Each: 0.05 max; Others Total: 0.15 max; Al remainder

Tensile test specimens were cut from 2139-T34 and a 2139-T8 base material (BM), as well as from friction stir welds (FSW), 4043 gas metal arc welded welds (GMAW), and 2139 GMAW welds on the fabricated weld test structure before heat ageing and after heat ageing. Tensile test specimens were harvested both in longitudinal and transverse orientations with respect to the rolling direction (base material) and the welds (weld test structure). Tensile test samples were machined and prepared in accordance with ASTM E739 and ISO 1143.

Test Results

Averaged results of tensile testing are shown in Table 2. In Table 2, "BM" means base material, "TYS" means tensile yield strength, "UTS" means ultimate tensile strength, "% E" means percent elongation, "MPa" means the unit megapascal, and "ksi" means the unit kilopound per square inch.

TABLE 2

| Averaged 2139 Tensile Test Data | | | | | | |
|---|---|---|---|---|---|---|
| | 2139-T34 | | 2139-T84 | | 2139-T8 | |
| Material Property | MPa | ksi | MPa | ksi | MPa | ksi |
| Average BM TYS (MPa) | 304 | 44 | 424 | 61 | 458 | 66 |
| Average BM UTS (MPa) | 432 | 63 | 467 | 68 | 492 | 71 |
| Average BM % E @ break | 29 | | 17 | | 14 | |
| Average FSW TYS (MPa) | 170 | 25 | 261 | 38 | 257 | 37 |
| Average FSW UTS (MPa) | 359 | 52 | 363 | 53 | 411 | 60 |
| Average FSW % E @ break | 28 | | 17 | | 16 | |
| Average 4043 GMAW TYS (MPa) | 92 | 13 | 127 | 18 | 171 | 25 |
| Average 4043 GMAW UTS (MPa) | 204 | 30 | 228 | 33 | 262 | 38 |
| Average 4043 GMAW % E @ break | 12 | | 10 | | 3 | |
| Average 2139 GMAW TYS (MPa) | | | 229 | 33 | | |
| Average 2139 GMAW UTS (MPa) | | | 305 | 44 | | |
| Average 2139 GMAW % E @ break | | | 6 | | | |

Figure 5:
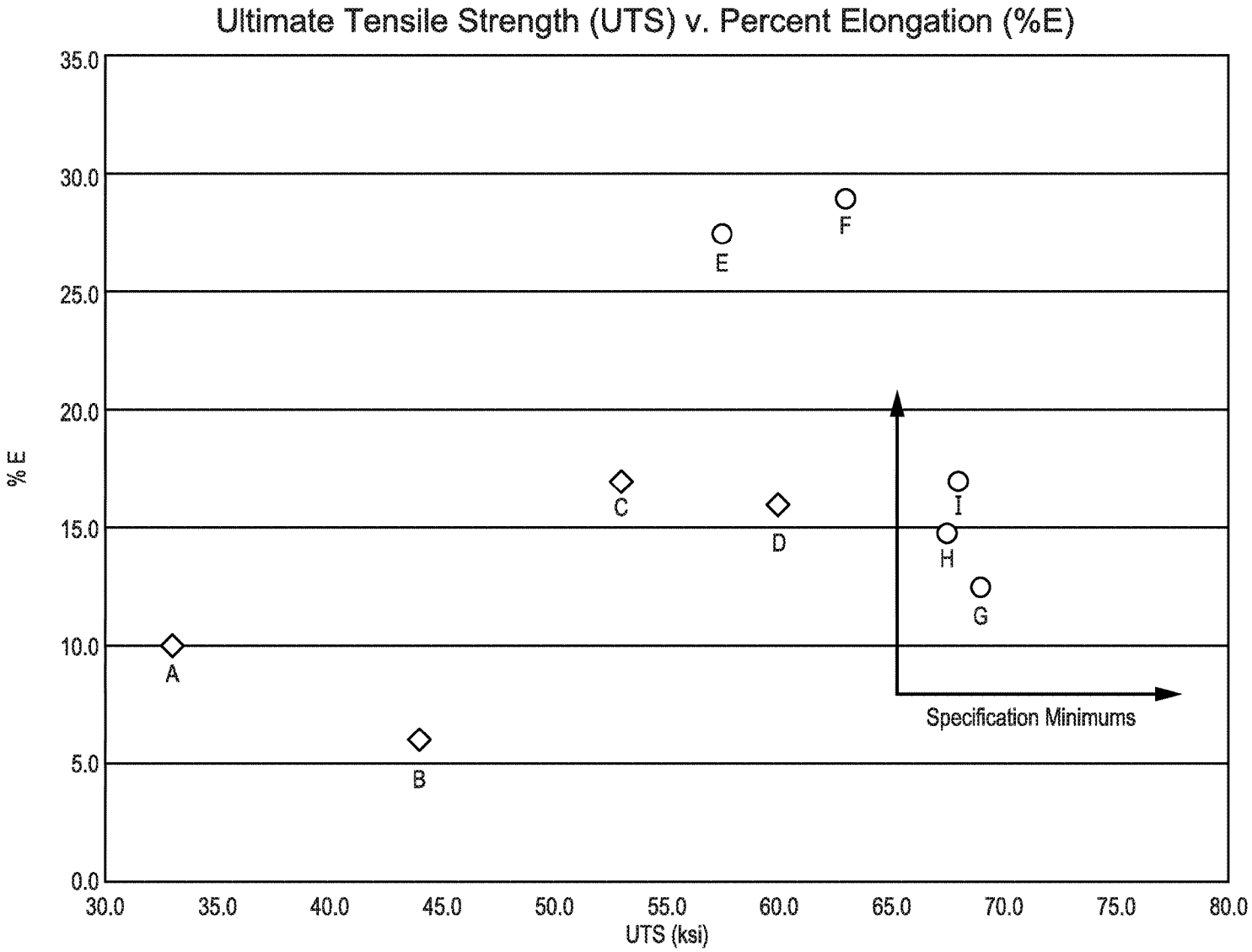
FIG. 5 provides a graph of ultimate tensile strength v. percent elongation for various aluminum structures, including structures according to some examples of this technology.

Further, FIG. 5 plots the Ultimate Tensile Strength ("UTS") v. Percent Elongation (% E) for 2139-T84 produced as described above against corresponding data for commercially available 2139-T34 and 2139-T8. More specifically, in FIG. 5: (A) Point A represents UTS v % E data across a GMAW joint of two Al 2139-T34 plates joined by a GMAW joint using 4043 weld wire after heat treating the weld to Al 2139-T84 temper; (B) Point B represents UTS v % E data across a GMAW joint according to this disclosure (joining two Al 2139-T34 plates using 2139 weld wire and then heat treating the weld joint to Al 2139-T84); (C) Point C represents UTS v % E data across a FSW joint according to this disclosure (joining two Al 2139-T34 plates using FSW and then heat treating the weld joint to Al 2139-T84); (D) Point D represents UTS v % E data across a FSW joint joining two Al 2139-T8 plates (the plates are already T8 temper when FSW welding occurred); (E) Point E represents published UTS v % E data for known Al 2139-T34; (F) Point F represents UTS v % E data for a typical Al 2139-T34 lot (e.g., Al 2139-T34 used as a starting material in this disclosure prior to heat treatment); (G) Point G represents published UTS v % E data for known Al 2139-T8; (H) Point H represents published UTS v % E data for known Al 2139-T84; and (I) Point I represents the UTS v % E data for Al 2139-T84 made in accordance with the present disclosure.

The 2139 weld wire shows substantial improvement in TYS over 4043 welds after aging to T84 (229 MPa for 2139 GMAW TYS v. 127 MPa for 4043 GMAW TYS).

Through the combined effects of using friction stir welding, gas metal arc welding with aluminum 2139-T34 weld wire, and heat ageing the welded structures to 2139-T84, e.g., as described above, greater than 90% of 2139-T8 base material properties ("BMP") is achieved and approximately 75% of BMP is recovered in the welds with little to no HAZ. Specifically, results show: (a) 2139-T84 FSW welds are stronger and more ductile than 2139-T8 FSW welds, (b) 2139-T84 TYS and UTS are >90% of 2139-T8 with 20% elongation at break, and (c) 2139-T84 welds using 2139 weld wire are more than 30% stronger than 2139-T8 welds using state of the art 4043 weld wire with a 100% increase in ductility in the weld. Also, post heat treatment metrology indicates that the process poses little to no risk to structural deformation or loss of integrity.

As described above, the resulting hull component product 100 in accordance with at least some aspects of this technology has substantially its entire structure formed from a homogeneous aluminum material, e.g. formed as aluminum 2139-T84. As some more specific examples, in at least some examples of this technology, the resulting heat treated vehicle hull structure 100 (e.g., aluminum 2139-T84) will be at least 75% homogenous, and in some examples, at least 80% homogeneous, at least 85% homogeneous, or even at least 90% homogeneous (the percentages in this context are based on volume of the part or parts under consideration). The resulting hull component product 100 further includes improved strength across its overall structure, including across the welded joints (both FSW and GMAW welded joints).

Hull component products 100 and/or other welded aluminum alloy products in accordance with aspects of this technology may include substantially improved strength across their entire structure, including across the welded joints, as compared to conventional products produced with different weld wire. In accordance with at least some aspects of this technology, this substantially improved strength is due to: (a) the use of aluminum 2139-T34 throughout the hull component product 100, including as the base material for component parts, in the FSW welds (due to the FSW process), and in the GMAW welded joints (from use of 2139-T34 weld wire in the GMAW process); (b) simultaneous and fully consistent heat treatment conditions for the entire hull component product 100—in assembled form—to heat treat all of the aluminum 2139-T34 starting material to aluminum 2139-T84; resulting in (c) the presence of aluminum 2139-T84 throughout the hull component product 100 (e.g., as a homogeneous or substantially homogeneous aluminum alloy structure and/or composition), including in the FSW and GMAW welded joints. Parts joined by welding (FSW and/or GMAW) in this manner are expected to have "substantially improved strength" as compared to the conventional hull structures described above (with aluminum 2139-T34 joined by 2319 or 4043 weld wire and heat treated to aluminum 2139-T8). Other aluminum alloy products made in accordance with aspects of this disclosure may include substantially improved strength across their entire structure, including across any FSW and/or GMAW welded joints when formed by: (a) using the same aluminum 2000 alloy throughout the component product, including as the base material for component parts, in any FSW welds (due to the FSW process), and in any GMAW welded joints (from use of the same aluminum 2000 alloy weld wire in the GMAW process); (b) simultaneous and fully consistent heat treatment of the entire product—in assembled form—to heat treat the aluminum 2000 alloy starting material to a hardened, heat treated aluminum 2000 alloy; resulting in (c) the presence of the heat treated aluminum 2000 alloy throughout the product (e.g., as a homogeneous or substantially homogeneous aluminum alloy structure and/or composition), including in the FSW and GMAW welded joints.

This homogeneous or substantially homogeneous vehicle hull structure translates to stronger and stiffer parts, including across weld seams, with better ballistic performance than conventional aluminum hulls. Also, the lack of and/or reduction in HAZ contributes to reducing ballistic and blast vulnerability, and improves the overall structural strength. These factors allow for equal or better performance as a conventional aluminum 2139-T8 tactical vehicle hull but with a thinner material (e.g., base material thicknesses of 0.75 in. to 1 in. (19 mm to 25.4 mm) for the present 2139-T84 vehicle hull vs. typical 2139-T8 hull thicknesses of 1.75 in. (44 mm) or more). As a more specific example of this aspect of the present disclosure, it is expected that using the thinner vehicle hull components (e.g., aluminum 2139-T34 treated to aluminum 2139-T84 as described) will result in production of a tactical vehicle hull having a weight of about 5000 lbs. That weight is about 15% lower than that of a corresponding vehicle hull made from the conventional aluminum 2139-T8 process. Based on the data above, it is expected that the vehicle hull according to this technology still will provide similar force resistance properties and/or no substantial change in performance (e.g., blast protection, useful life term, etc.). The structural weight savings, due to the reduced armor thicknesses, can be transferred to weaponry and sensory payloads without sacrificing speed and protection.

Further, reduction in the number of hull component parts and/or the ability to produce tighter bend radii in those hull component parts, in combination with the combined use of FSW and GMAW in accordance with aspects of this technology, is expected to reduce the linear feet of welds within the vehicle hull 100 structure (as compared to a corresponding conventional vehicle hull) by at least 40%, and in some examples, at least 50%, at least 60%, or even by at least 70%.

Conclusion

For the avoidance of doubt, the present application includes, but is not limited to, the subject-matter described in the following numbered clauses:

1. An aluminum structure, comprising:
a first aluminum component formed from a first alloy composition;
a second aluminum component formed from the first alloy composition; and
a gas metal arc welded joint joining the first aluminum component to the second aluminum component, wherein the gas metal arc welded joint comprises an aluminum alloy weld material formed from the first alloy composition.
2. The aluminum structure of clause 1, wherein the first aluminum component, the second aluminum component, and the gas metal arc welded joint have a substantially homogeneous composition and structure.
3. The aluminum structure of clause 1 or 2, wherein the first alloy composition is a member selected from the group consisting of: an aluminum 2000 series alloy; 2139-T34 aluminum; 2139-T84 aluminum; and any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.
4. The aluminum structure of any one of clauses 1 to 3, wherein the gas metal arc welded joint joins a first portion of the first aluminum component to a first portion of the second aluminum component, and wherein the aluminum structure further comprises:
a friction stir welded joint joining a second portion of the first aluminum component to a second portion of the second aluminum component.
5. The aluminum structure of clause 4, wherein the gas metal arc welded joint has a gas metal arc welded seam length $L_{GMA}$, wherein the friction stir welding joint has a friction stir welded seam length $L_{FS}$, and wherein a ratio of $L_{FS}$:$L_{GMA}$ is at least 1, within a range of 1.5 to 5, or within a range of 1.75 to 4.
6. The aluminum structure of any one of clauses 1 to 5, wherein the aluminum structure is a vehicle hull for an armored vehicle, and wherein each of the first aluminum component and the second aluminum component is a vehicle hull component part.
7. A vehicle hull for an armored vehicle, comprising:
a plurality of hull component parts each comprising an aluminum component having a first alloy composition, wherein the plurality of hull component parts combine to form at least portions of a bottom wall, a first sidewall, and a second sidewall of the vehicle hull;
a plurality of welded joints joining the plurality of component parts, wherein the plurality of welded joints includes: (a) a plurality of friction stir welded joints and (b) a plurality of gas metal arc welded joints, wherein the plurality of gas metal arc welded joints are formed from the first alloy composition.
8. The vehicle hull of clause 7, wherein said portions of the bottom wall, the first sidewall, the second sidewall, and the gas metal arc welded joints have a substantially homogeneous composition and structure.
9. The vehicle hull of clause 7 or 8, wherein the first alloy composition is a member selected from the group consisting of: an aluminum 2000 series alloy; 2139-T34 aluminum; or 2139-T84 aluminum.
10. The vehicle hull of clause 7 or 8, wherein the first alloy composition includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.
11. The vehicle hull of any one of clauses 7 to 10, wherein any one or more of the first sidewall, the second sidewall, and the bottom wall has a thickness measured directly from a first major surface to a second major surface thereof of 1 inch (25.4 mm) or less through at least 50% of a surface area of the first major surface.
12. The vehicle hull of any one of clauses 7 to 11, wherein a top component part is joined to the bottom wall at least in part by a friction stir welded joint.
13. A vehicle hull for an armored vehicle hull, comprising:
a first sidewall part comprising a first aluminum component having a first alloy composition;
a second sidewall part comprising a second aluminum component having the first alloy composition;
a bottom component part comprising a third aluminum component having the first alloy composition, wherein the bottom component part is joined to the first sidewall part by a first welded joint and joined to the second sidewall part by a second welded joint;
a rear component part comprising a fourth aluminum component having the first alloy composition, wherein the rear component part is joined to the first sidewall part by a third welded joint, joined to the second sidewall part by a fourth welded joint, and joined to the bottom component part by a fifth welded joint; and a top component part comprising a fifth aluminum component having the first alloy composition, wherein the top component part is joined to the first sidewall part by a sixed welded joint, joined to the second sidewall part by a seventh welded joint, and joined to the rear component part by an eighth welded joint, wherein individual seams forming the first welded joint, the second welded joint, the third welded joint, the fourth welded joint, the fifth welded joint, the sixth welded joint, the seventh welded joint, and the eight welded joint include both: (a) a plurality of friction stir welded seams and (b) a plurality of gas metal arc welded seams, wherein the gas metal arc welded seams are formed from the first alloy composition.

14. The vehicle hull of clause 13, wherein the first alloy composition is a member selected from the group consisting of: an aluminum 2000 series alloy; 2139-T34 aluminum; or 2139-T84 aluminum.

15. The vehicle hull of clause 13, wherein the first alloy composition includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

16. The vehicle hull of any one of clauses 13 to 15, wherein any one or more of the first sidewall component part, the second sidewall component part, the bottom component part, the rear component part, and the top component part has a thickness measured directly from a first major surface to a second major surface thereof of 1 inch (25.4 mm) or less through at least 50% of a surface area of the first major surface.

17. The vehicle hull of any one of clauses 13 to 16, further comprising:

a first front side panel joined to the top component part, to the bottom component part, and to one of the first sidewall component part or the second sidewall component part by plural welded joints; and/or a second front side panel joined to the top component part, to the bottom component part, and to the second sidewall component part by a second plurality of additional welded joints.

18. A vehicle hull for an armored vehicle hull, comprising:

a plurality of hull component parts each comprising an aluminum component having a first alloy composition, wherein the plurality of hull component parts combine to form at least portions of a bottom wall, a first sidewall, and a second sidewall of the vehicle hull;

a plurality of welded joints joining the plurality of component parts, wherein the plurality of welded joints includes: (a) a plurality of friction stir welded joints forming a total friction stir welded seam length $L_{TFSW}$ joining the plurality of component parts and (b) a plurality of gas metal arc welded joints forming a total gas metal arc welded seam length $L_{TGMAW}$ joining the plurality of component parts, wherein the plurality of gas metal arc welded joints are formed using aluminum alloy weld material, wherein a ratio of $L_{TFSW}$:$L_{TGMAW}$ is at least 1, within a range of 1.5 to 5, or within a range of 1.75 to 4.

19. The vehicle hull of clause 18, wherein the aluminum alloy weld material is formed from the first alloy composition.

20. The vehicle hull of clause 18 or 19, wherein said portions of the bottom wall, the first sidewall, the second sidewall, and the gas metal arc welded joints have a substantially homogeneous composition and structure.

21. The vehicle hull of any one of clauses 18 to 20, wherein each of the first alloy composition and the aluminum alloy weld material is 2139-T34 aluminum.

22. The vehicle hull of any one of clauses 18 to 20, wherein the first alloy composition is 2139-T84 aluminum.

23. The vehicle hull of any one of clauses 18 to 20, wherein each of the first alloy composition and the aluminum alloy weld material includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

24. The vehicle hull of any one of clauses 18 to 23, wherein any one or more of the first sidewall, the second sidewall, and the bottom wall has a thickness measured directly from a first major surface to a second major surface thereof of 1 inch (25.4 mm) or less through at least 50% of a surface area of the first major surface.

25. The vehicle hull of any one of clauses 18 to 24, wherein a top component part is joined to the bottom wall at least in part by a friction stir welded joint.

26. A vehicle hull for an armored vehicle hull, comprising:

a first sidewall part comprising a first aluminum component having a first alloy composition;

a second sidewall part comprising a second aluminum component having the first alloy composition;

a bottom component part comprising a third aluminum component having the first alloy composition, wherein the bottom component part is joined to the first sidewall part by a first welded joint and joined to the second sidewall part by a second welded joint;

a rear component part comprising a fourth aluminum component having the first alloy composition, wherein the rear component part is joined to the first sidewall part by a third welded joint, joined to the second sidewall part by a fourth welded joint, and joined to the bottom component part by a fifth welded joint; and a top component part comprising a fifth aluminum component having the first alloy composition, wherein the top component part is joined to the first sidewall part by a sixed welded joint, joined to the second sidewall part by a seventh welded joint, and joined to the rear component part by an eighth welded joint, wherein lengths of individual seams forming the first welded joint, the second welded joint, the third welded joint, the fourth welded joint, the fifth welded joint, the sixth welded joint, the seventh welded joint, and the eight welded joint form a total welded joint seam length, wherein the total welded joint seam length includes both: (a) a total friction stir welded seam length $L_{TFSW}$ corresponding to a total length of friction stir welded seams joining the first sidewall component part, the second sidewall component part, the bottom component part, the rear component part, and the top component part and (b) a total gas metal arc welded seam length $L_{TGMAW}$ corresponding to a total length of gas metal arc welded seams joining the first sidewall component part, the second sidewall component part, the bottom component part, the rear component part, and the top component part, wherein the gas metal arc welded joints are formed using aluminum alloy weld material, and wherein a ratio of $L_{TFSW}$:$L_{TGMAW}$ is at least 1, within a range of 1.5 to 5, or within a range of 1.75 to 4.

27. The vehicle hull of clause 26, wherein the aluminum alloy weld material is formed from the first alloy composition.

28. The vehicle hull of clause 26 or 27, wherein the first sidewall component part, the second sidewall component part, the bottom component part, the rear component part, the top component part, and the total length of the gas metal arc welded seams have a substantially homogeneous composition and structure.

29. The vehicle hull of any one of clauses 26 to 28, wherein each of the first alloy composition and the aluminum alloy weld material is 2139-T34 aluminum.

30. The vehicle hull of any one of clauses 26 to 28, wherein the first alloy composition is 2139-T84 aluminum.

31. The vehicle hull of any one of clauses 26 to 28, wherein each of the first alloy composition and the aluminum alloy weld material includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

32. The vehicle hull of any one of clauses 26 to 31, wherein any one or more of the first sidewall component part, the second sidewall component part, the bottom component part, the rear component part, and the top component part has a thickness measured directly from a first major surface to a second major surface thereof of 1 inch (25.4 mm) or less through at least 50% of a surface area of the first major surface.

33. The vehicle hull of any one of clauses 26 to 32, wherein the top component part is joined to the bottom component part at least in part by a friction stir welded joint.

34. The vehicle hull of any one of clauses 26 to 33, further comprising:

a first front side panel joined to the top component part, to the bottom component part, and to one of the first sidewall component part or the second sidewall component part by plural welded joints; and/or a second front side panel joined to the top component part, to the bottom component part, and to the second sidewall component part by a second plurality of additional welded joints.

35. A method of joining at least two aluminum components together, comprising:

placing a first aluminum component having a first alloy composition adjacent a second aluminum component having the first alloy composition;

gas metal arc welding the first aluminum component to the second aluminum component with an aluminum alloy weld material to form a welded part having a gas metal arc welded joint, wherein the aluminum alloy weld material has the first alloy composition; and after welding, heat treating the welded part to simultaneously temper the first alloy composition of the first aluminum component, the second aluminum component, and the aluminum alloy weld material to form a heat treated part.

36. The method of clause 35, wherein the first aluminum component, the second aluminum component, and the gas metal arc welded joint of the heat treated part have a substantially homogeneous composition and structure.

37. The method of clause 35 or 36, wherein the first alloy composition is 2139-T34 aluminum, and wherein the heat treated part is 2139-T84 aluminum, and/or wherein the first alloy composition includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

38. The method of any one of clauses 35 to 37, wherein the gas metal arc welding step joins a first portion of the first aluminum component to a first portion of the second aluminum component, and wherein the method further comprising:

friction stir welding a second portion of the first aluminum component to a second portion of the second aluminum component prior to the heat treating step.

39. The method of clause 38, wherein the gas metal arc welded joint has a gas metal arc welded seam length $L_{GMA}$, wherein the friction stir welding step forms a friction stir welded joint having a friction stir welded seam length $L_{FS}$, and wherein a ratio of $L_{FS}$:$L_{GMA}$ for the welded part is at least 1, within a range of 1.5 to 5, or within a range of 1.75 to 4.

40. The method of any one of clauses 35 to 39, wherein the method forms a vehicle hull for an armored vehicle, and wherein each of the first aluminum component and the second aluminum component is a vehicle hull component part.

41. The method of any one of clauses 35 to 40, wherein prior to the gas metal arc welding step, the method further comprises:

bending at least one of the first aluminum component or the second aluminum component; and/or machining at least one of the first aluminum component or the second aluminum component to a predetermined size.

42. A method of forming an armored vehicle hull, comprising:

forming a first hull component part from a first aluminum component made from a first alloy composition;

forming a second hull component part from a second aluminum component made from the first alloy composition;

friction stir welding a first portion of the first hull component part to a first portion of the second hull component part to form a friction stir welded joint;

gas metal arc welding a second portion of the first hull component part to a second portion of the second hull component part with an aluminum alloy weld material made from the first alloy composition to form a gas metal arc welded joint, wherein the first hull component part and the second hull component part are joined together during the friction stir welding step and the gas metal arc welding step to form a vehicle hull component part; and after the friction stir welding and gas metal arc welding steps, heat treating the vehicle hull component part to simultaneously temper the first alloy composition of the first hull component part, the second hull component part, and the aluminum alloy weld material to form a heat treated vehicle hull component part.

43. The method of clause 42, wherein the first hull component part, the second hull component part, and the gas metal arc welded joint of the heat treated vehicle hull component part have a substantially homogeneous composition and structure.

44. The method of clause 42 or 43, wherein the first alloy composition is 2139-T34 aluminum, and wherein the heat treated vehicle hull component part is 2139-T84 aluminum.

45. The method of any one of clauses 42 to 44, wherein the gas metal arc welded joint has a gas metal arc welded seam length $L_{GMA}$, wherein the friction stir welded joint has a friction stir welded seam length $L_{FS}$, and wherein a ratio of $L_{FS}$:$L_{GMA}$ in the vehicle hull component part is at least 1, within a range of 1.5 to 5, or within a range of 1.75 to 4.

46. The method of any one of clauses 42 to 45, wherein the first alloy composition includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

47. The method of any one of clauses 42 to 46, wherein at least one of the step of forming the first hull component part and the step of forming the second hull component part includes: (a) bending at least one of the first aluminum component or the second aluminum component and/or (b) machining at least one of the first aluminum component or the second aluminum component to a predetermined size.

48. The method of any one of clauses 42 to 47, wherein the first hull component part has a first major surface and a second major surface opposite the first major surface, wherein a thickness of the first hull component part measured directly from the first major surface to the second major surface is 1 inch (25.4 mm) or less through at least 50% of a surface area of the first major surface.

49. A method of forming an armored vehicle hull, comprising:

forming a plurality of hull component parts from separate aluminum components made from a first alloy composition;

friction stir welding at least some of the plurality of hull component parts to others of the plurality of hull component parts thereby forming a plurality of friction stir welded joints;

gas metal arc welding at least some of the plurality of hull component parts to others of the plurality of hull component parts with an aluminum alloy weld material made from the first alloy composition to form a plurality of gas metal arc welded joints, wherein the plurality of hull component parts are joined together during the friction stir welding step and the gas metal arc welding step to form a vehicle hull component part; and after the friction stir welding and gas metal arc welding steps, heat treating the vehicle hull component part to simultaneously temper the first alloy composition of the plurality of hull component parts and the aluminum alloy weld material to form an armored vehicle hull part.

50. The method of clause 49, wherein the plurality of hull component parts and the plurality of gas metal arc welded joints of the armor vehicle hull have a substantially homogeneous composition and structure.

51. The method of clause 49 or 50, wherein the first alloy composition is 2139-T34 aluminum, and wherein the armored vehicle hull part is 2139-T84 aluminum.

52. The method of clause 49 or 50, wherein the first alloy composition includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

53. The method of any one of clauses 49 to 52, wherein the step of forming the plurality of hull component parts includes: (a) bending at least one of the plurality of hull component parts; and/or (b) machining at least one of the plurality of hull component parts to a predetermined size.

54. The method of any one of clauses 49 to 53, wherein any individual one or more of the plurality of hull component parts includes a first major surface and a second major surface opposite the first major surface, wherein a thickness of each of said majority of the plurality of hull component parts measured directly from the first major surface to the second major surface thereof is 1 inch (25.4 mm) or less through at least 50% of a surface area of the first major surface of the respective hull component part.

55. The method of any one of clauses 49 to 54, wherein the plurality of hull component parts includes: a first sidewall part; a second sidewall part; a bottom base part extending between the first sidewall part and the second sidewall part; a top part; and a rear part.

56. The method of any one of clauses 49 to 55, wherein the plurality of gas metal arc welded joints joining the plurality of hull component parts form a total gas metal arc welded seam length $L_{GMAT}$ in the armored vehicle hull part, wherein the plurality of friction stir welded joints form a total friction stir welded seam length $L_{FST}$ in the armored vehicle hull part, and wherein a ratio of $L_{FST}$:$L_{GMAT}$ is at least 1, within a range of 1.5 to 5, or within a range of 1.75 to 4.

57. A method of making an armored vehicle hull, comprising:

forming a plurality of hull component parts each comprising an aluminum component having a first alloy composition, wherein the plurality of hull component parts combine to form at least portions of a bottom wall, a first sidewall, and a second sidewall of the armored vehicle hull;

joining the plurality of hull component parts using a plurality of welded joints, wherein the plurality of welded joints includes: (a) a plurality of friction stir welded joints forming a total friction stir welded seam length $L_{TFSW}$ joining the plurality of component parts and (b) a plurality of gas metal arc welded joints forming a total gas metal arc welded seam length $L_{TGMAW}$ joining the plurality of component parts, wherein the plurality of gas metal arc welded joints are formed using aluminum alloy weld material, wherein a ratio of $L_{TFSW}$:$L_{TGMAW}$ is at least 1, within a range of 1.5 to 5, or within a range of 1.75 to 4.

58. The method of clause 57, wherein the aluminum alloy weld material is formed from the first alloy composition.

59. The method of clause 57 or 58, wherein said portions of the bottom wall, the first sidewall, the second sidewall, and the gas metal arc welded joints have a substantially homogeneous composition and structure.

60. The method of any one of clauses 57 to 59, wherein each of the first alloy composition and the aluminum alloy weld material is 2139-T34 aluminum.

61. The method of any one of clauses 57 to 59, wherein the first alloy composition is 2139-T84 aluminum.

62. The method of any one of clauses 57 to 59, wherein each of the first alloy composition and the aluminum alloy weld material includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

63. The method of any one of clauses 57 to 62, wherein the step of forming the hull component parts includes bending at least one of the first sidewall, the second sidewall, and the bottom wall.

64. The method of any one of clauses 57 to 63, wherein any one or more of the first sidewall, the second sidewall, and the bottom wall has a thickness measured directly from a first major surface to a second major surface thereof of 1 inch (25.4 mm) or less through at least 50% of a surface area of the first major surface.

65. The method of any one of clauses 57 to 64, further comprising joining a top component part to the bottom wall at least in part by friction stir welding.

66. A method of forming an armored vehicle hull, comprising:

forming a first sidewall part comprising a first aluminum component having a first alloy composition;

forming a second sidewall part comprising a second aluminum component having the first alloy composition;

forming a bottom component part comprising a third aluminum component having the first alloy composition;

forming a rear component part comprising a fourth aluminum component having the first alloy composition;

forming a top component part comprising a fifth aluminum component having the first alloy composition;

joining the bottom component part to the first sidewall part by a first welded joint and to the second sidewall part by a second welded joint;

joining the rear component part: (a) to the first sidewall part by a third welded joint, (b) to the second sidewall part by a fourth welded joint, and (c) to the bottom component part by a fifth welded joint;

joining the top component part: (a) to the first sidewall part by a sixed welded joint, (b) to the second sidewall part by a seventh welded joint, and (c) to the rear component part by an eighth welded joint, wherein lengths of individual seams forming the first welded joint, the second welded joint, the third welded joint, the fourth welded joint, the fifth welded joint, the sixth welded joint, the seventh welded joint, and the eight welded joint form a total welded joint seam length, wherein the total welded joint seam length includes both: (a) a total friction stir welded seam length $L_{TFSW}$ corresponding to a total length of friction stir welded seams joining the first sidewall component part, the second sidewall component part, the bottom component part, the rear component part, and the top component part and (b) a total gas metal arc welded seam length $L_{TGMAW}$ corresponding to a total length of gas metal arc welded seams joining the first sidewall component part, the second sidewall component part, the bottom component part, the rear component part, and the top component part, wherein the gas metal arc welded joints are formed using aluminum alloy weld material, and wherein a ratio of $L_{TFSW}$:$L_{TGMAW}$ is at least 1, within a range of 1.5 to 5, or within a range of 1.75 to 4.

67. The method of clause 66, wherein the aluminum alloy weld material is formed from the first alloy composition.

68. method of clause 66 or 67, wherein the first sidewall component part, the second sidewall component part, the bottom component part, the rear component part, the top component part, and the total length of the gas metal arc welded seams have a substantially homogeneous composition and structure.

69. The method of any one of clauses 66 to 68, wherein each of the first alloy composition and the aluminum alloy weld material is 2139-T34 aluminum.

70. The method of any one of clauses 66 to 68, wherein the first alloy composition is 2139-T84 aluminum.

71. The method of any one of clauses 66 to 68, wherein each of the first alloy composition and the aluminum alloy weld material includes any alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (l) total of any other metals, up to 0.15%, and (m) aluminum, remainder.

72. The method of any one of clauses 66 to 71, wherein the forming step for forming at least one of the first sidewall component part, the second sidewall component part, the bottom component part, the rear component part, and the top component part includes bending the respective component part.

73. The method of any one of clauses 66 to 72, wherein any one or more of the first sidewall component part, the second sidewall component part, the bottom component part, the rear component part, and the top component part has a thickness measured directly from a first major surface to a second major surface thereof of 1 inch (25.4 mm) or less through at least 50% of a surface area of the first major surface.

74. The method of any one of clauses 66 to 73, further comprising joining the top component part to the bottom component part at least in part by friction stir welding.

75. The method of any one of clauses 66 to 74, further comprising:

joining a first front side panel to the top component part, to the bottom component part, and to the first sidewall component part by a first plurality of additional welded joints; and/or joining a second front side panel to the top component part, to the bottom component part, and to the second sidewall component part by a second plurality of additional welded joints.

76. A product produced by the method described in any one of clauses 35 to 75.

The foregoing has been presented for purposes of example. The foregoing is not intended to be exhaustive or to limit features to the precise form disclosed. The examples discussed herein were chosen and described in order to explain principles and the nature of various examples and their practical application to enable one skilled in the art to use these and other implementations with various modifications as are suited to the particular use contemplated. The scope of this disclosure encompasses, but is not limited to, any and all combinations, subcombinations, and permutations of structure, operations, and/or other features described herein and in the accompanying drawing figures.

The invention claimed is:

1. A method of forming an armored vehicle hull, comprising:

forming a plurality of hull component parts from separate aluminum components made from a first alloy composition;

friction stir welding at least some of the plurality of hull component parts to others of the plurality of hull component parts thereby forming a plurality of friction stir welded joints;

gas metal arc welding at least some of the plurality of hull component parts to others of the plurality of hull component parts with an aluminum alloy weld material made from the first alloy composition to form a plurality of gas metal arc welded joints, wherein the plurality of hull component parts are joined together during the friction stir welding step and the gas metal arc welding step to form a vehicle hull component part; and after the friction stir welding and gas metal arc welding steps, heat treating the vehicle hull component part to simultaneously temper the first alloy composition of the plurality of hull component parts and the aluminum alloy weld material to form an armored vehicle hull part.

2. The method of claim 1, wherein the first alloy composition is 2139-T34 aluminum, and wherein the armored vehicle hull part is 2139-T84 aluminum.

3. The method of claim 1, wherein the plurality of gas metal arc welded joints joining the plurality of hull component parts form a total gas metal arc welded seam length $L_{GMAT}$ in the armored vehicle hull part, wherein the plurality of friction stir welded joints form a total friction stir welded seam length $L_{FST}$ in the armored vehicle hull part, and wherein a ratio of $L_{FST}$:$L_{GMAT}$ is in a range of 1.5 to 5.

4. The method of claim 1, wherein the step of forming the plurality of hull component parts includes bending at least one of the plurality of hull component parts.

5. The method of claim 1, wherein the step of forming the plurality of hull component parts includes machining at least one of the plurality of hull component parts to a predetermined size.

6. The method of claim 1, wherein the plurality of hull component parts includes:

a first hull component part having a first major surface and a second major surface opposite the first major surface, wherein a thickness of the first hull component part measured directly from the first major surface to the second major surface is 25.4 mm or less through at least 50% of a surface area of the first major surface; and a second hull component part having a first major surface and a second major surface opposite the first major surface of the second hull component part, wherein a thickness of the second hull component part measured directly from the first major surface of the second hull component part to the second major surface of the second hull component part is 25.4 mm or less through at least 50% of a surface area of the first major surface of the second hull component part.

7. The method of claim 1, wherein each of a majority of the plurality of hull component parts includes a first major surface and a second major surface opposite the first major surface, wherein a thickness of each of said majority of the plurality of hull component parts measured directly from the first major surface to the second major surface thereof is 25.4 mm or less through at least 50% of a surface area of the first major surface of the respective hull component part.

8. The method of claim 1, wherein each of the plurality of hull component parts includes a first major surface and a second major surface opposite the first major surface, wherein a thickness of each of the plurality of hull component parts measured directly from the first major surface to the second major surface thereof is 25.4 mm or less through at least 50% of a surface area of the first major surface of the respective hull component part.

9. The method of claim 1, wherein the plurality of hull component parts includes: a first sidewall part; a second sidewall part; a bottom base part extending between the first sidewall part and the second sidewall part; a top part; and a rear part, and wherein the first sidewall part, the second sidewall part, the bottom base part, the top part, and the rear part are joined to one another by a first linear length of the plurality of gas metal arc welded joints and by a second linear length of the plurality of friction stir welded joints, and wherein a ratio of the second linear length to the first linear length is in a range of 1.5 to 5.

10. The method of claim 1, wherein the first alloy composition is 2139-T34 aluminum, wherein the plurality of gas metal arc welded joints joining the plurality of hull component parts form a total gas metal arc welded seam length $L_{GMAT}$ in the armored vehicle hull part, wherein the plurality of friction stir welded joints form a total friction stir welded seam length $L_{FST}$ in the armored vehicle hull part, and wherein a ratio of $L_{FST}$:$L_{GMAT}$ is at least 1.

11. The method of claim 1, wherein the first alloy composition is 2139-T34 aluminum, and wherein the plurality of hull component parts includes:

(a) a first hull component part having a first major surface and a second major surface opposite the first major surface, wherein a thickness of the first hull component part measured directly from the first major surface to the second major surface is 25.4 mm or less through at least 50% of a surface area of the first major surface; and (b) a second hull component part having a first major surface and a second major surface opposite the first major surface of the second hull component part, wherein a thickness of the second hull component part measured directly from the first major surface of the second hull component part to the second major surface of the second hull component part is 25.4 mm or less through at least 50% of a surface area of the first major surface of the second hull component part.

12. The method of claim 1, wherein the first alloy composition is 2139-T34 aluminum, wherein the plurality of hull component parts includes: a first sidewall part; a second sidewall part; a bottom base part extending between the first sidewall part and the second sidewall part; a top part; and a rear part, and wherein the first sidewall part, the second sidewall part, the bottom base part, the top part, and the rear part are joined to one another by a first linear length of the plurality of gas metal arc welded joints and by a second linear length of the plurality of friction stir welded joints, and wherein a ratio of the second linear length to the first linear length is at least 1.

13. The method of claim 1, wherein the first alloy composition includes an alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (1) total of any other metals, up to 0.15%, and (m) aluminum, remainder.

14. A method of forming an armored vehicle hull, comprising:

forming a first hull component part from a first aluminum component made from a first alloy composition;

forming a second hull component part from a second aluminum component made from the first alloy composition;

friction stir welding a first portion of the first hull component part to a first portion of the second hull component part to form a friction stir welded joint;

gas metal arc welding a second portion of the first hull component part to a second portion of the second hull component part with an aluminum alloy weld material made from the first alloy composition to form a gas metal arc welded joint, wherein the first hull component part and the second hull component part are joined together during the friction stir welding step and the gas metal arc welding step to form a vehicle hull component part; and after the friction stir welding and gas metal arc welding steps, heat treating the vehicle hull component part to simultaneously temper the first alloy composition of the first hull component part, the second hull component part, and the aluminum alloy weld material to form a heat treated vehicle hull component part.

15. The method of claim 14, wherein the first alloy composition is 2139-T34 aluminum, and wherein the heat treated vehicle hull component part is 2139-T84 aluminum.

16. The method of claim 14, wherein the gas metal arc welded joint has a gas metal arc welded seam length $L_{GMA}$, wherein the friction stir welded joint has a friction stir welded seam length $L_{FS}$, and wherein a ratio of $L_{FS}$:$L_{GMA}$ in the vehicle hull component part is at least 1.

17. The method of claim 14, wherein at least one of the step of forming the first hull component part and the step of forming the second hull component part includes: (a) bending at least one of the first aluminum component or the second aluminum component and/or (b) machining at least one of the first aluminum component or the second aluminum component to a predetermined size.

18. The method of claim 14, wherein the first hull component part has a first major surface and a second major surface opposite the first major surface, wherein a thickness of the first hull component part measured directly from the first major surface to the second major surface is 25.4 mm or less through at least 50% of a surface area of the first major surface.

19. The method of claim 14, wherein the first alloy composition is 2139-T34 aluminum, wherein the gas metal arc welded joint has a gas metal arc welded seam length $L_{GMA}$, wherein the friction stir welded joint has a friction stir welded seam length $L_{FS}$, and wherein a ratio of $L_{FS}$:$L_{GMA}$ in the vehicle hull component part is at least 1.

20. The method of claim 14, wherein the first alloy composition is 2139-T34 aluminum, wherein the first hull component part has a first major surface and a second major surface opposite the first major surface, and wherein a thickness of the first hull component part measured directly from the first major surface to the second major surface is 25.4 mm or less through at least 50% of a surface area of the first major surface.

21. The method of claim 14, wherein the first alloy composition includes an alloy composition having components as follows: (a) Si, up to 0.1%; (b) Fe, up to 0.15%, (c) Cu, 4.5% to 5.5%; (d) Mn, 0.2% to 0.6%, (e) Mg, 0.2% to 0.8%, (f) Cr, up to 0.05%, (g) Zn, up to 0.25%, (h) Ti, up to 0.15%, (i) Ag, 0.15% to 0.6%; (j) V, up to 0.05%, (k) any other individual metal, up to 0.05%, (1) total of any other metals, up to 0.15%, and (m) aluminum, remainder.

* * * * *